US006105956A

United States Patent [19]

Park

[11] Patent Number: 6,105,956

[45] **Date of Patent: *Aug. 22, 2000**

[54] SHEET FEEDING WITH LATERAL ADJUSTABLE FINGER

[75] Inventor: Jin-Ho Park, Kyungki-do, Rep. of Korea

[73] Assignee: SamSung Electronics Co., Ltd., Kyungki-do, Rep. of Korea

[ * ] Notice: This patent issued on a continued prosecution application filed under 37 CFR 1.53(d), and is subject to the twenty year patent term provisions of 35 U.S.C. 154(a)(2).

[21] Appl. No.: 08/985,177

[22] Filed: Dec. 4, 1997

[30] Foreign Application Priority Data

Dec. 4, 1996 [KR] Rep. of Korea ..... 96-45578

[51] Int. Cl.[7] ..... B65H 3/54

[52] U.S. Cl. ..... 271/170; 271/171

[58] Field of Search ..... 271/169, 170, 271/171

[56] References Cited

U.S. PATENT DOCUMENTS

| | | | |
|---|---|---|---|
| Re. 25,825 | 7/1965 | Springer | 271/170 |
| 3,310,303 | 3/1967 | Schmidt | 271/170 |
| 3,592,462 | 7/1971 | Fackler | 271/170 |
| 3,610,576 | 10/1971 | Brooke | 271/8.1 |
| 3,652,083 | 3/1972 | Bosshardt | 271/170 X |
| 3,713,645 | 1/1973 | Ferrari et al. | 271/170 |
| 3,727,910 | 4/1973 | Vora | 271/170 |
| 4,245,831 | 1/1981 | Michatek | 271/171 |
| 4,279,504 | 7/1981 | Brown et al. . | |
| 4,343,461 | 8/1982 | Tomimori et al. | 271/170 |
| 4,558,858 | 12/1985 | Runzi | 271/171 X |
| 4,569,587 | 2/1986 | Miyoshi et al. . | |
| 4,780,740 | 10/1988 | Fukae . | |
| 4,922,291 | 5/1990 | Adachi . | |
| 5,328,166 | 7/1994 | Hokamura . | |
| 5,419,645 | 5/1995 | Russo . | |
| 5,437,444 | 8/1995 | Kawakami et al. | 271/171 X |

*Primary Examiner*—Christopher P. Ellis
*Assistant Examiner*—Patrick Mackey
*Attorney, Agent, or Firm*—Robert E. Bushnell, Esq.

[57] ABSTRACT

A one-sheet feeding device for an ink-jet printer includes a feeding roller for supplying paper sheets, and a finger having an overlap piece put on the edge of paper for paper separation. The overlap amount of the finger with the paper sheet put under the overlap piece varies by a finger adjusting means. The finger adjusting means has: a control shaft installed on a frame to idle and having a screw for finger movement; a nut hole to which the screw is fastened; and a knob for rotating the control shaft for finger movement. According to the rigidness of paper used, the overlap amount of paper with the finger varies, thereby enhancing paper feeding reliability.

20 Claims, 9 Drawing Sheets

SHEET FEEDING WITH LATERAL ADJUSTABLE FINGER

CLAIM OF PRIORITY

This application makes reference to, incorporates the same herein, and claims all benefits accruing under 35 U.S.C. §119 from an application entitled One-Sheet Feeding Device for Ink-Jet Printer earlier filed in the Korean Industrial Property Office on the $4^{th}$ day of December 1996, and there duly assigned Ser. No. 96-45578 by that Office.

1. Field of the Invention

The present invention relates to a one sheet feeding process and device for supplying paper sheets, one by one, using a finger in a mode for automatically supplying paper sheets in an ink-jet printer. More particularly, this invention relates to a one sheet feeding process and device for an inkjet printer improved to adjust a one-sheet separator according to the thickness or rigidness of paper used.

2. Description of the Prior Art

Generally speaking, in a one-sheet feeding devices of contemporary designs such as those illustrated by FIGS. 1 through 5 described below, supply sheets of paper one by one using a finger.

Occasionally however, either a sheet of paper is not supplied or more than one sheet of is supplied. Moreover, there are variations in the rigidness of paper stock so that false feeding or multifeed may occur due to the finger's resistance with a great amount of overlap or due to the finger's weakness with a small amount of overlap. Rigid or thick paper cannot escape from the finger, and to the contrary soft or thin paper is too easily departed from the finger, causing multifeed where more than one sheet comes out of the finger at once. For this reason, a paper feeding device of prior art where the overlap amount is fixed independent of different kinds of paper does not ensure perfect reliability in paper feeding, decreasing the product's reliability.

SUMMARY OF THE INVENTION

Therefore, in order to overcome such drawbacks of the prior art, an objective of the present invention is to provide a one-sheet feeding device for an ink-jet printer, which is designed to adjust the overlap amount of a one-sheet separator according to the rigidness of paper.

The present invention is characterized in that the finger is adjusted so that for rigid paper, the overlap amount of the finger with paper is reduced, while for thin or soft paper, the overlap amount of finger increases. In one aspect of the present invention, there is provided a one-sheet feeding device for an ink-jet printer having a feeding roller for supplying paper sheets, and a finger having an overlap piece put on the edge of paper for paper separation, wherein the overlap amount of the finger with the paper sheet put under the overlap piece varies by a finger adjusting mechanism.

The finger adjusting mechanism is manually controlled so that the finger moves left and right by a control screw shaft having a knob.

The finger adjusting means may be additionally controlled automatically so that the control screw shaft is rotated by a motor.

According to the rigidness or thickness of paper loaded on the one-sheet feeding device, the finger moves left or right with the finger adjusting means so that the overlap amount of finger with paper varies, facilitating paper feeding.

BRIEF DESCRIPTION OF THE DRAWINGS

A more complete appreciation of the invention, and many of the attendant advantages thereof, will be readily apparent as the same becomes better understood by reference to the following detailed description when considered in conjunction with the accompanying drawings in which like reference symbols indicate the same or similar components, wherein.

DETAILED DESCRIPTION OF THE INVENTION

Figure 1:
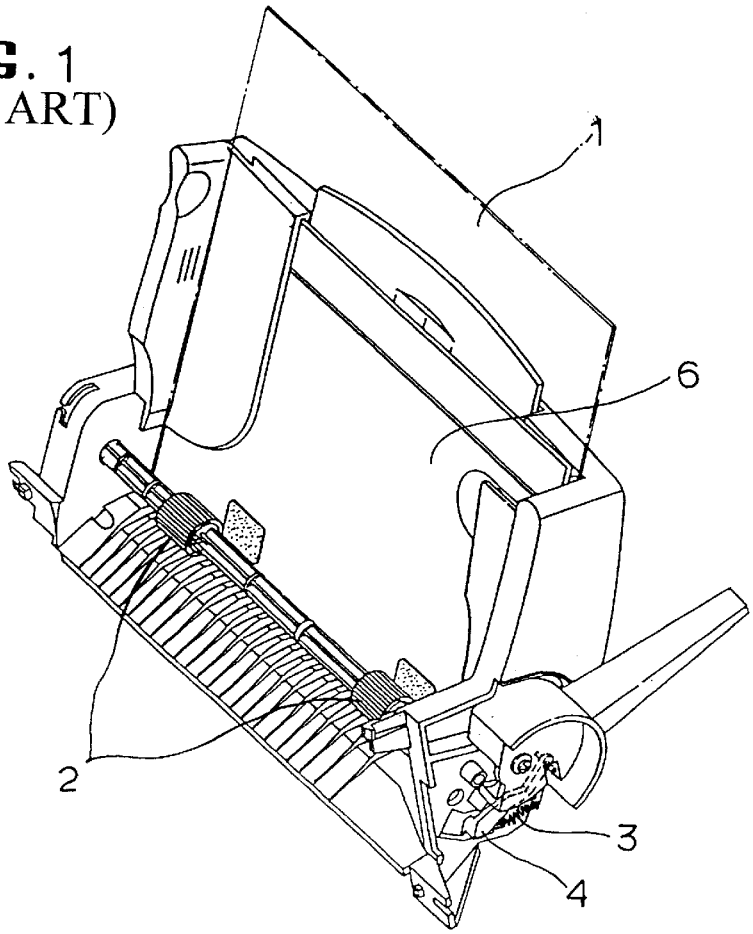
FIG. 1 (PRIOR ART)
FIG. 1 is a perspective view of a one-sheet paper feeding device according to prior art.

Turning now to the drawings, generally in a one-sheet feeding device of the type shown in FIG. 1, sheets of paper are sequently supplied, one by one, by using a finger, according to the overlap amount of finger 4 with the edge of paper 1. Paper 1 is occasionally not supplied however, because feeding roller 2 slips against the paper, or multiple sheets (e.g., multifeed) may be fed because more than one sheet of paper escapes from finger 4 at once due to finger 4's weak resistance against the paper.

Figure 2:
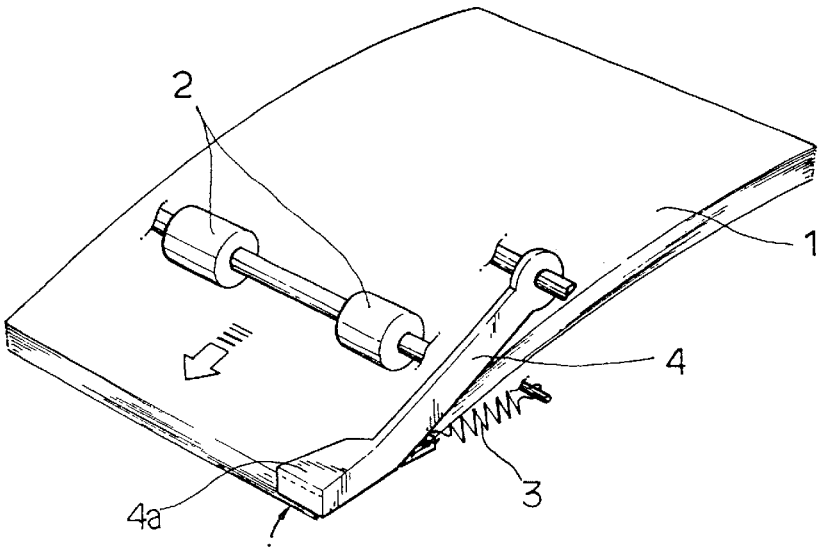
FIG. 2 (PRIOR ART)
FIG. 2 is a schematic perspective view of the device shown in FIG. 1.
Figure 3:
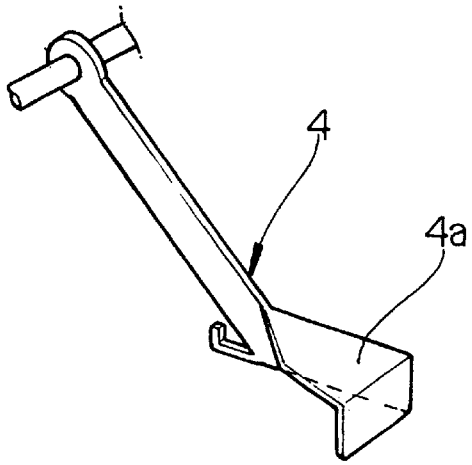
FIG. 3 (PRIOR ART)
FIG. 3 is a perspective view of the finger which separates paper in the one-sheet feeding device.
Figure 4A:
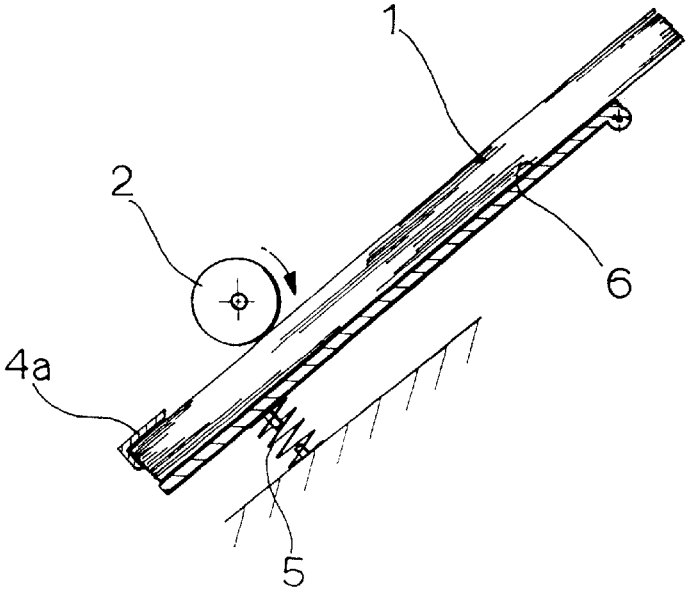
FIG. 4A (PRIOR ART)
FIG. 4*a* is a schematic side sectional view of showing the initial state where paper is separated by the finger of the one-sheet feeding device.
Figure 4B:
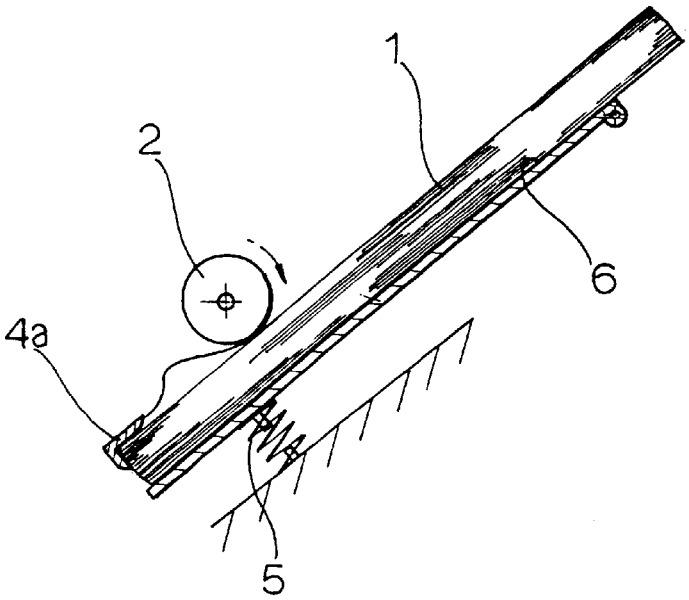
FIG. 4B (PRIOR ART)
FIG. 4*b* is a schematic side sectional view of showing the operation state where paper is separated by the finger of the one-sheet feeding device.
Figure 4C:
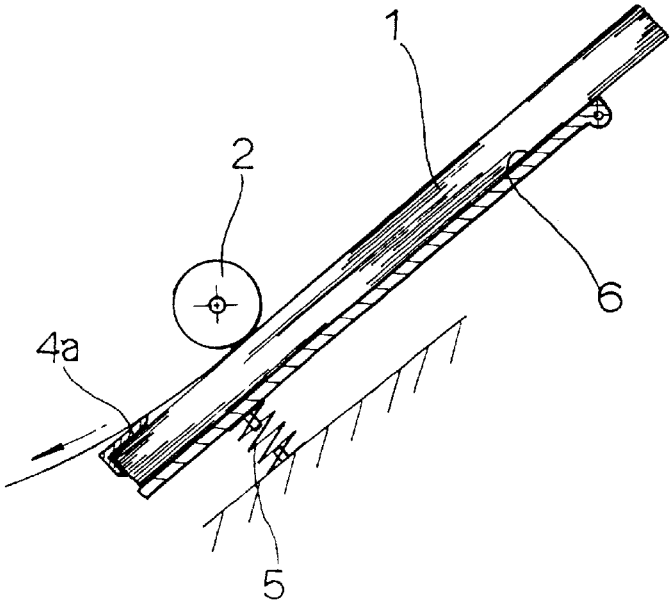
FIG. 4C (PRIOR ART)
FIG. 4*c* is a schematic side sectional view of showing the state where the paper separation by the finger is completed.
Figure 5:
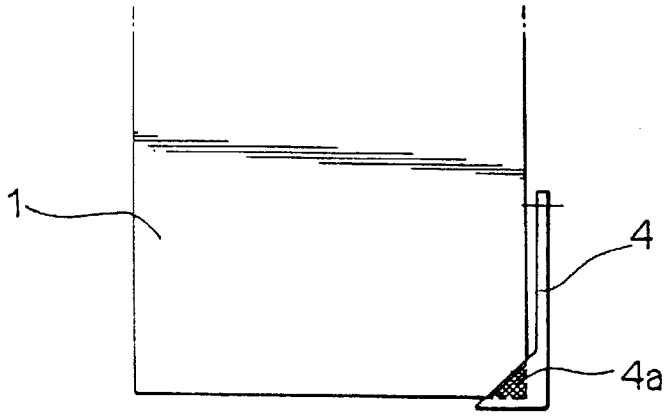
FIG. 5 (PRIOR ART)
FIG. 5 is a schematic plan view of the range of overlap amount by the finger according to the prior art.

As depicted in FIG. 2, paper 1 is conveyed by feeding roller 2, and finger 4 elastic by a resilient member 3 overlaps with paper 1 as much as its amount inserted into overlap piece 4*a*. The range of overlap between the corner 14*b* of finger 4 and paper 1 is indicated by the checkered portion in FIG. 5. As shown in FIGS. 4*a*, 4*b* and 4*c*, finger 4 acts to supply paper 1 one by one on a paper feeding plate 6 compressed with the resilience of elastic member 5. Stocks of paper 1 vary in rigidness so that false feeding or multifeed may occur due to the finger's resistance with a great amount of overlap or due to the finger's weakness with a small amount of overlap.

Figure 6:
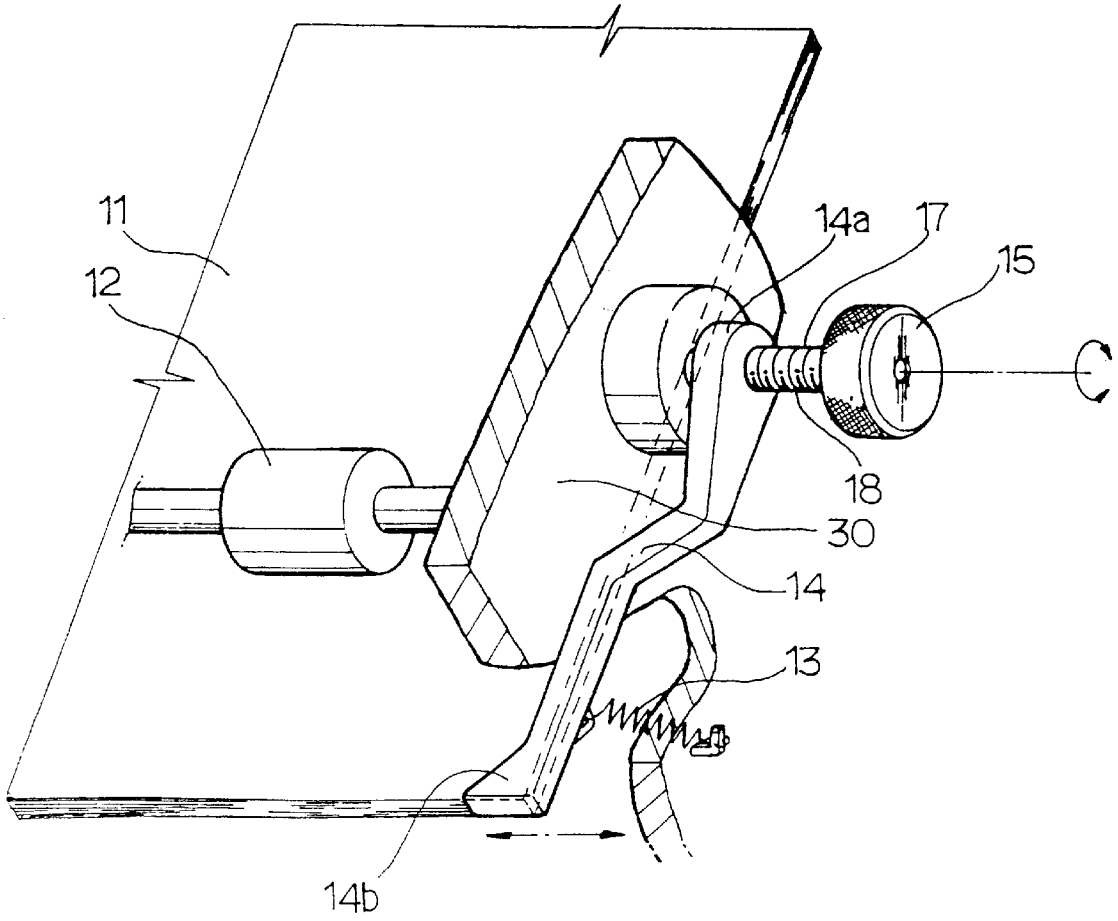
FIG. 6 is a perspective view of important components of a one-sheet feeding device constructed according to the principles of the present invention.
Figure 7:
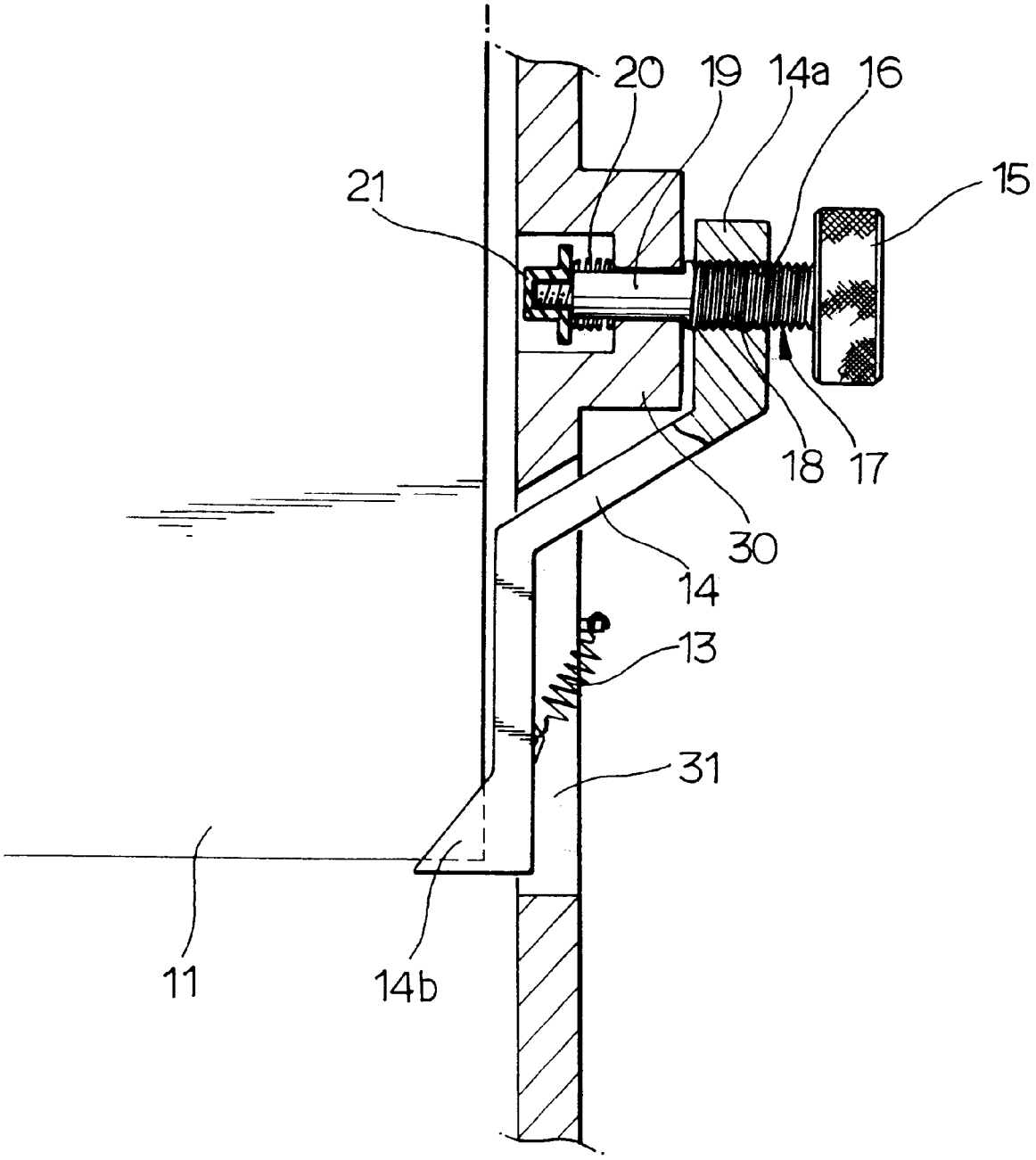
FIG. 7 is a plan view of a state where the finger is adjusted to increase the overlap amount of paper according to the principles of the present invention.
Figure 8:
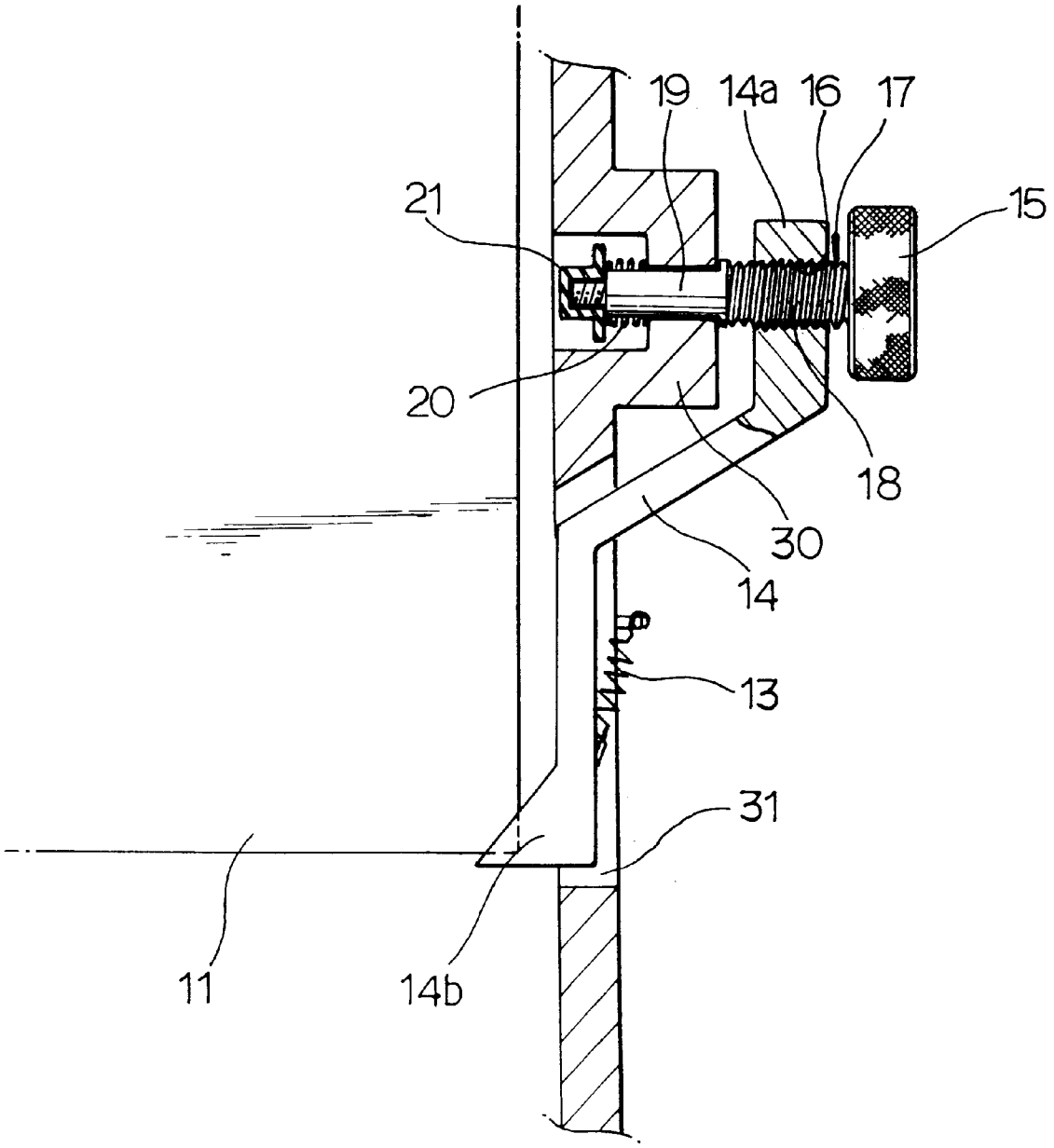
FIG. 8 is a plan view of a state where the finger is adjusted to reduce the overlap amount of paper according to the principles of the present invention.

Hereinafter, preferred embodiments of the present invention will be described with reference to the attached drawings. Referring therefore to FIGS. 6, 7 and 8, there are provided a feeding roller 12 for carrying paper 11, and a finger 14 for enabling paper 11 to be supplied one by one. Finger 14 is made in such a manner that a threaded nut hole 16 is formed on rear boss 14*a*, and a screw 18 of control shaft 17 supported to frame 30 and installed to idle is fastened into the hole.

The control shaft 17 has a knob 15 that can rotate manually in front of screw 18, and a support shaft 19 at the rear of screw 18. Support shaft 19 is installed to pass through frame 30 and extends there over. A resilient member 20 is provided on the support shaft. In order to prevent resilient member 20 from being detached and at the same time to maintain its elasticity, a cap nut 21 is fastened to the outer end of support shaft 19. A compression coil spring is used for resilient member 20. The resilient member 20 pushes cap nut 21 outward to pull the control shaft 17 so that it can idle using frame 30 as a support member without shaking.

Finger 14 has an overlap piece 14*b* in its lower end which allows paper 11 wait for being inserted for feeding. The overlap piece 14*b* is designed to be placed inside frame 30 via finger passing hole 31 formed on frame 30. A resilient member 13 for always pulling the overlap piece 14*b* downward is connected between finger 14 and frame 30. A tensile coil spring is used for the resilient member 13. The edge of paper 11 inserted inside overlap piece 14*b* of finger 14 is pressed by the piece affected by resilient member 13. When knob 15 is rotated left or right, the whole control shaft 17 rotates. Here, resilient member 20 and cap nut 21 slip against each other not to interrupt the rotation of control shaft 17. When the control shaft 17 rotates, screw 18 rotates so that finger 14 with nut hole 16 moves left or right.

FIG. 7 shows a state where finger 14 moves left by the rotation of control shaft 17, and FIG. 8 shows that finger 14 moves right. As control shaft 17 rotates, finger 14 accepts the rotation of control shaft 17, and thus tries to rotate upward or downward. However, resilient member 13 pulls the finger from the opposite side so that it can be prevented from rotating upward. In addition, the finger is not rotated downward because overlap piece 14*b* is put on the edge of paper 11. Since the finger 14 is not rotated up and down when control shaft 17 rotates, the finger can move left and right.

Figure 9A:
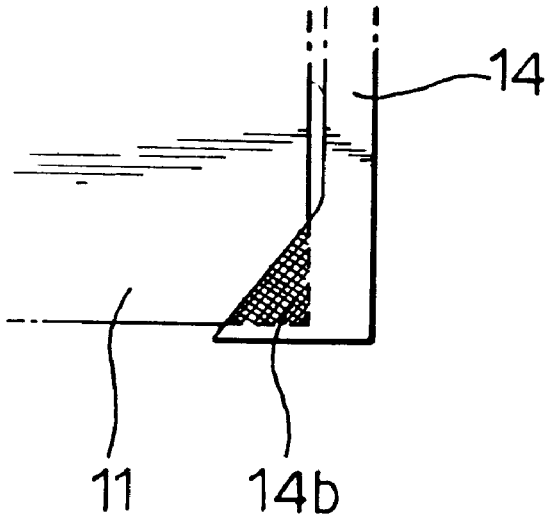
FIGS. 9*a* and 9*b* are plan views of explaining the overlap amount of paper and finger according to the principles of the present invention.
Figure 9B:
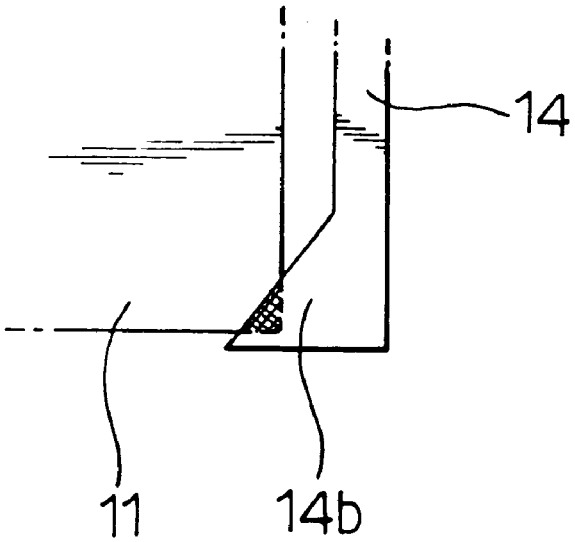

FIGS. 9*a* and 9*b* show the overlap amounts between the overlap piece 14*b* and paper 11 when the finger 14 moves left or right. As in FIG. 9*a*, if there is a large amount of overlap, the overlap piece 14*b* has a great resistance against the edge of paper 11. This state allows soft or thin paper sheets to be used. As in FIG. 9*b*, if there is a small amount of overlap, rigid thick paper 11 can be used because the overlap piece 14*b* has a small resistance against the edge of paper 11. For plain paper, the finger 14 is controlled to be placed in the middle of FIGS. 9*a* and 9*b*. When the finger is completely adjusted, the control shaft 17 is fixed as far as it is not rotated forcibly because it is always pulled by resilient member 20. For this reason, finger 14 is not required to be fixed additionally.

Figure 10:
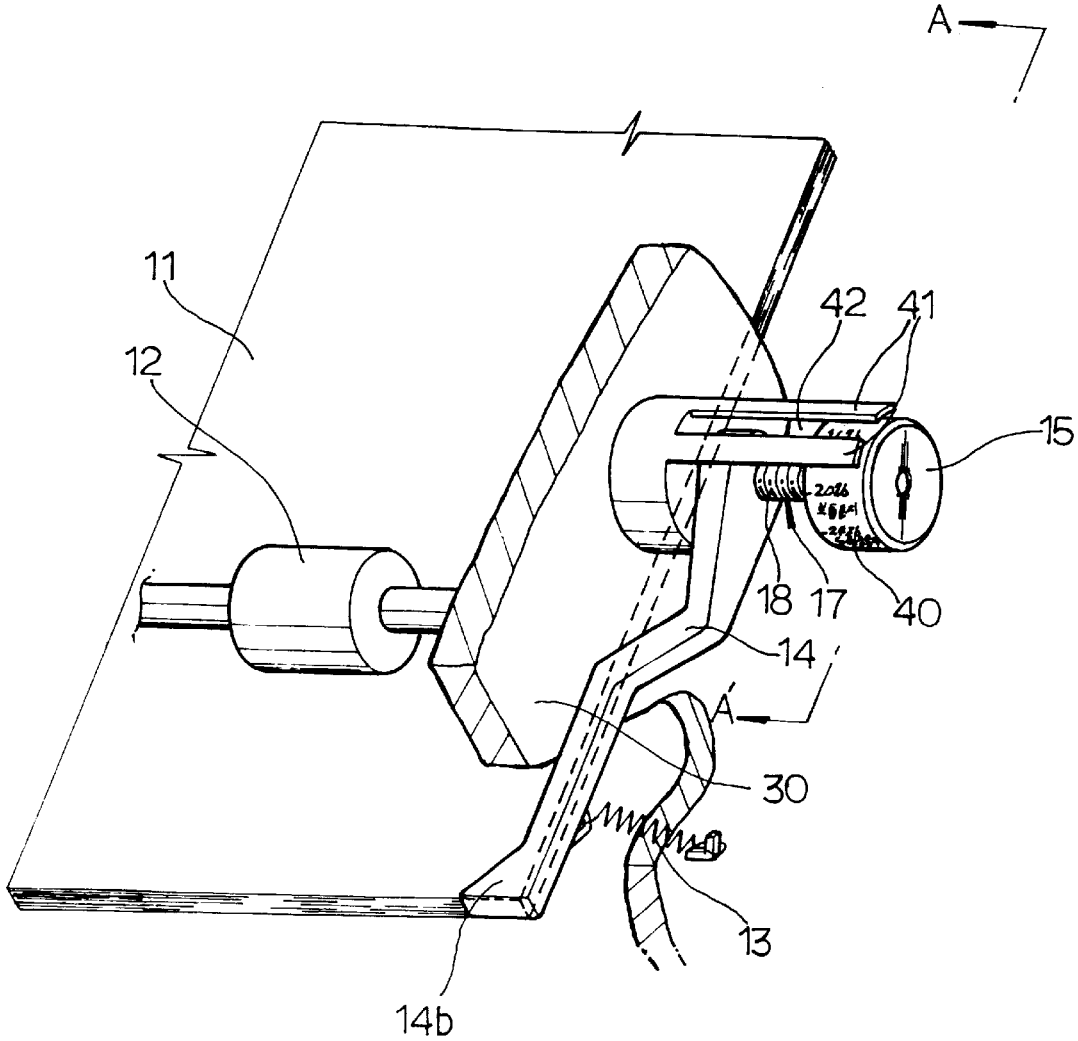
FIG. 10 is a perspective view of another embodiment of one-sheet feeding device of the present invention where the finger is precisely controlled.
Figure 11:
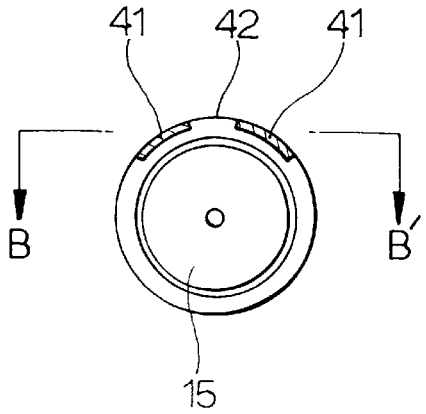
FIG. 11 is an extracted sectional view of important components of the one-sheet feeding device cut along line XI–XI' of FIG. 10.
Figure 12:
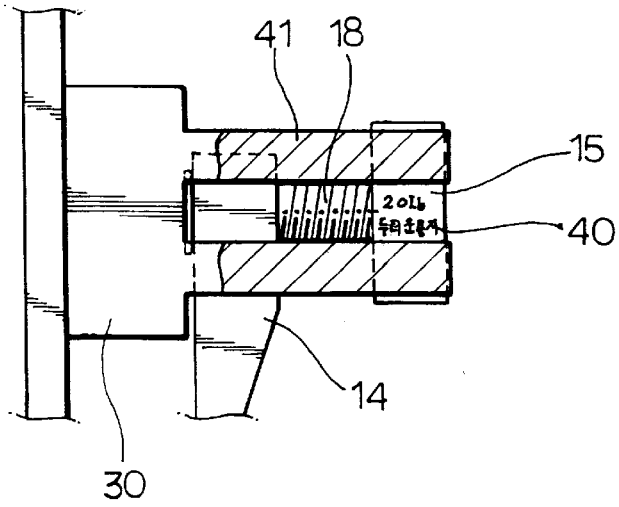
FIG. 12 is an enlarged sectional view of the one-sheet feeding device cut along line XII–XII' of FIG. 11.

Referring to FIGS. 10, 11 and 12, this embodiment is constructed to allow the user to easily and exactly adjust finger 14 in accordance with the size of paper 11. Specifically turning to FIGS. 10 and 11, some indications such as thin, normal or thick are suggested on the circumference of knob 15. Instead standard numbers 40 may be represented. The characters 40 are shown through an indication hole 42 formed between a pair of shielding members 41 extendedly installed on frame 30. When knob 15 rotates to show the characters 40 indicative of appropriate paper size through indication hole 42, as in FIG. 12, finger 14 moves to the position coinciding with the paper size used.

Figure 13:
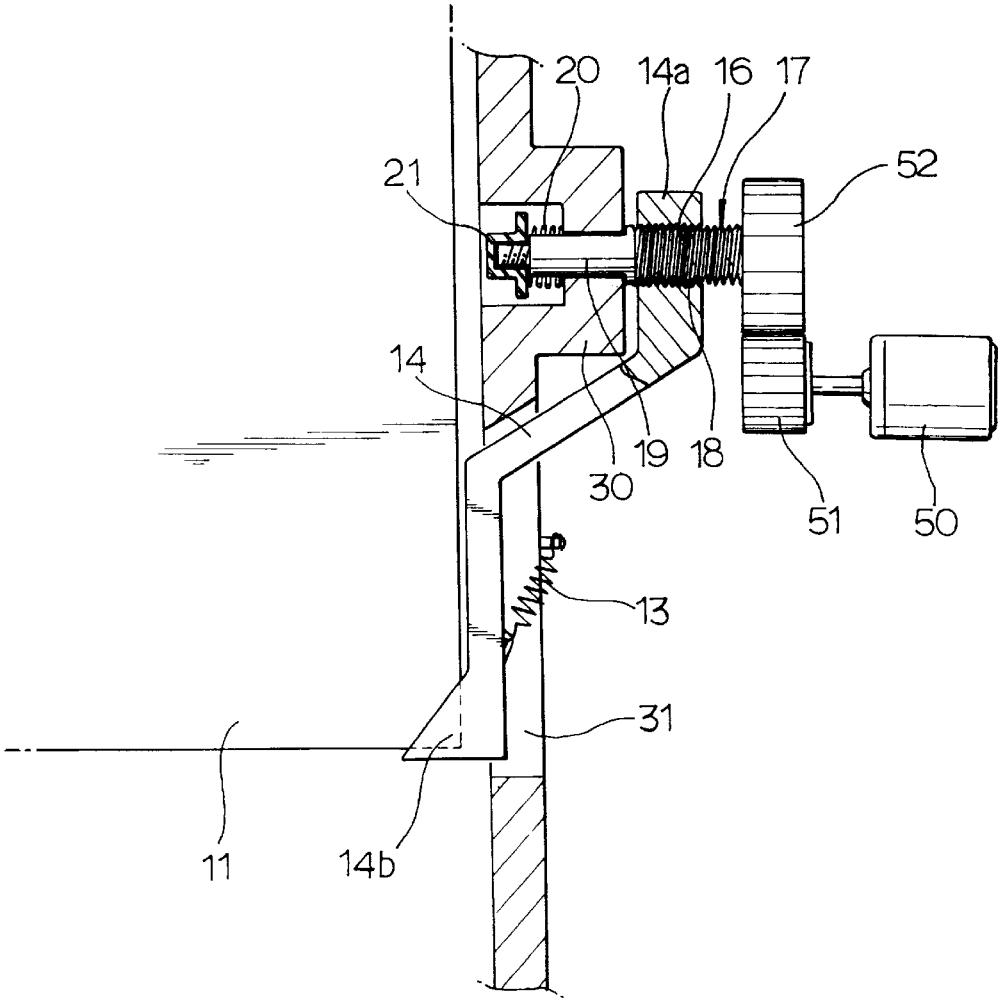
FIG. 13 is a schematic view of still another embodiment of the present invention where the finger is automatically controlled.

FIG. 13 shows still another embodiment of the present invention. In this embodiment control shaft 17 is rotated by a forward/reverse motor 50 and gears 51 and 52 so that finger 14 moves left or right to allow the overlap amount to be variable. This embodiment has a system that controls the driving and stopping of forward/reverse motor 50 with a program. When the kind of paper is selected, the printer's controller automatically controls the finger through the operation of button or switch, having a finger overlap operator.

As described above, the present invention can adjust the overlap amount of finger on the edge of paper according to the kind of paper used in a printer, preventing paper jamming.

It will be apparent to the reader that the foregoing description of the invention has been presented for purposes of illustration and description and for providing an understanding of the invention and that many changes and modifications can be made without departing from the scope of the invention. It is therefore intended that the scope of the invention be indicated by the appended claims rather than by the foregoing description; and all changes which come within the meaning and range of equivalency of the claims are therefore intended to be embraced therein.

What is claimed is:

1. A sheet feeding device for a printer, comprising:

a feeding roller propelling a cut sheet from a paper tray and along a path of travel to said printer;

a finger having a corner positioned over an edge of the cut sheet facilitating separation of the cut sheet from a stack of cut sheets supported by said paper tray;

a frame extending along said direction of travel; and a control shaft supported by said frame while connected to said finger, adjusting an amount of overlap between the cut sheet and said corner by varying displacement between said frame and said finger in a direction transverse to said direction of travel.

2. The device as claimed in claim 1, further comprised of a knob attached to said control shaft enabling manual rotation of said control shaft to adjust said amount of said overlap between said corner and the cut sheet.

3. The device as claimed in claim 1, further comprised of said control shaft having a support shaft penetrating said frame.

4. A sheet feeding device for a printer, comprising:

a paper tray comprising a frame extending along and defining one side of said tray;

a feeding roller supplying a cut sheet from said paper tray to said printer;

a finger having a corner positioned over an edge of the cut sheet separating the cut sheet from a stack of sheets supported by said paper tray;

a control shaft connected to said finger, installed in said frame and attaching said finger to said frame while accommodating adjustments in separation between said finger and said frame;

a knob attached to said control shaft enabling said adjustments by rotation of said shaft; and an elastic member exerting a force on said control shaft to pull said control shaft and said finger toward said frame.

5. The device as claimed in claim 4, wherein said elastic member is secured over said support shaft by a cap nut.

6. The device as claimed in claim 4, wherein the elastic member is a compression coil spring.

7. The device as claimed in claim 6, wherein the elastic member is a compression coil spring.

8. The device as claimed in claim wherein said knob has a plurality of alphanumeric characters on an outer circumference of said knob representing different values of said amount of said overlap.

9. The device as claimed in claim 8, wherein said alphanumeric characters representing said amount of said overlap are visible through a perforation formed between a plurality of shields attached to said frame.

10. The device as claimed in claim 8, wherein said alphanumeric characters represent said amount of said overlap.

11. The device as claimed in claim 2, further comprised of a motor and a gear driven by said motor while engaging said control shaft to adjust said amount of said overlap by rotating said control shaft in a selected one of a forward and a reverse direction.

12. A sheet feeding device, comprising:

a paper tray supporting a stack of cut sheets of printable media;

a feed roller sequentially loading each cut sheet by moving each cut sheet from said tray and along a path of conveyance;

a finger attached to said paper tray;

a corner positioned on one end of said finger, overlapping a junction of two sides and a major surface of the stack; and a control shaft rotatably engaging said tray and supporting said finger in an adjustable disposition to said paper tray, adjusting an amount of an overlap between said cut sheet and said corner by varying displacement of said finger relative to said tray in a direction transverse to said path independently of and variation along said direction of a width of said path.

13. The device of claim 12, further comprising a motor connected to said control shaft, rotating said control shaft and causing said control shaft to vary said overlap.

14. A paper tray with an overlap piece overlapping a corner of a plurality of cut sheets of a printable medium comprising:

a pickup roller feeding said cut sheets of said printable medium individually into said image forming apparatus;

a tray contained in a frame and supporting said cut sheets, said frame having a first hole on a side;

a first elastic member positioned between said tray and said frame and applying a separating force to both said tray and said frame;

a finger having a second hole and being secured to said frame by a shaft penetrating both said second hole of said finger and said first hole of said paper tray, said finger having said overlap piece positioned on an end of said finger, said overlap piece overlapping said corner of the topmost of said cut sheets;

a second elastic member secured to said shaft and pulling said finger towards a side of said frame; and said shaft having a knob on an outwardly facing distal end and having a screw along a segment of said shaft engaging a nut hole in said finger, said finger being movable toward and apart from said frame to adjust said amount of over lap between said overlap piece and said cut sheets by rotating said knob.

15. The paper tray of claim 14, further comprising a locking cap attached to a second distal end of said shaft and securing said shaft and said finger to said frame.

16. The device of claim 15, further comprising said frame having a space portion along said side allowing said shaft to protrude into the inside of said paper tray without said locking cap contacting said cut sheets of said printable medium.

17. The paper tray of claim 14, further comprising a third elastic member connected at one end to said finger at a position close to said distal end supporting said overlap piece and connected at a second end to said frame.

18. The paper tray of claim 14, further comprising a motor driving said knob to adjust said finger, said motor connected to said knob via at least one gear.

19. The device of claim 12, further comprised of a knob attached to said shaft, rotating said shaft to move said overlap piece of said finger toward and apart from said frame in order to adjust said amount of said overlap between said cut sheet and said overlap piece.

20. The device of claim 1, further comprised of an elastic member secured to said control shaft.

* * * * *